United States Patent [19]

Creagan

[11] Patent Number: 4,948,467

[45] Date of Patent: Aug. 14, 1990

[54] EXTENDED NIP PRESS WITH INDUCED REPULSION

[75] Inventor: Richard W. Creagan, Kirkland, Canada

[73] Assignee: The Black Clawson Company, Middletown, Ohio

[21] Appl. No.: 353,289

[22] Filed: May 17, 1989

[51] Int. Cl.[5] ..... D21F 3/02

[52] U.S. Cl. ..... 162/358; 100/153; 100/917; 162/305

[58] Field of Search ..... 162/305, 358; 100/118, 100/121, 153, 154, 917

[56] References Cited

U.S. PATENT DOCUMENTS

| | | | |
|---|---|---|---|
| Re. 29,451 | 10/1977 | Beermann | 335/303 |
| 3,067,718 | 12/1962 | Kraft | 118/58 |
| 3,216,349 | 11/1965 | Kraft | 101/123 |
| 3,407,415 | 10/1968 | McGee, Jr. | 8/151 |
| 3,413,915 | 12/1968 | Goodwin et al. . | |
| 3,720,160 | 3/1973 | Kraft et al. | 100/160 |
| 3,860,368 | 1/1975 | Kertula et al. | 100/DIG. 17 |
| 4,366,025 | 12/1982 | Gordon, Jr. et al. | 162/358 |
| 4,704,191 | 11/1987 | Wedel | 162/358 |
| 4,803,837 | 2/1989 | Seider | 310/12 |

FOREIGN PATENT DOCUMENTS

| | | | |
|---|---|---|---|
| 0014564 | 1/1980 | European Pat. Off. . | |
| 0095356 | 11/1983 | European Pat. Off. . | |
| 1160762 | 8/1969 | United Kingdom | 162/358 |

*Primary Examiner*—Karen M. Hastings

*Attorney, Agent, or Firm*—Biebel, French & Nauman

[57] ABSTRACT

An extended nip press for papermaking machine extracts water from a web of paper on a forming felt passing over a backing roll employing electromagnetic repulsion forces. In one embodiment, a belt is formed with permanent magnets which have thickness oriented poles and a like pole is provided external to the belt surface in non-contacting relation to provide a repulsion force to the belt which is transmitted by the belt to the felt and the paper. In another embodiment, the belt is formed of current-carrying nonferrous material and a repulsion force is formed by inducing current to flow in the belt by causing current to flow in an adjacent coil in non-contacting relation to the belt. In either embodiment, air pressure housing may be positioned over the electromagnet or conductor, to cool the electromagnet and to apply an air pressure force against the belt in the same direction as that of the induced or repulsion force.

3 Claims, 2 Drawing Sheets

EXTENDED NIP PRESS WITH INDUCED REPULSION

BACKGROUND OF THE INVENTION

This invention relates to extending nip presses, and to such a press useful in the papermaker's art, in which a newly-formed web of paper is carried on the surface of a felt, and is subjected to a dewatering or pressing force. In such extended nip presses, the felt and web carried on the felt are partially wrapped over a dewatering roll, and pressure is applied to the felt to force the felt against the roll. The dewatering or extraction roll may take the form of a grooved roll or perforated shell for recovery of water from the felt.

Magnetics has been suggested as the means for generating a pressing force in the nip of an extended nip press, by pressing a shoe against an impervious belt running against the felt, as shown in the U.S. Pat. No. 4,704,191 of Wedel, issued Nov. 3, 1987. In the devices suggested in this reference, an electromagnet is the motive device, and magnetic attraction between the electromagnet and the backing roll provided a squeezing or pressing force to the felt and web. Since this type of apparatus requires a direct physical contact with the belt, such as through a stainless shoe, friction is formed at the nip by the pressing force. This friction is a source of unnecessary wear, heat and wasted energy. The arrangements suggested by this reference therefore require the application of a liquid, such as water, as a lubricant and coolant to reduce friction and to remove heat.

SUMMARY OF THE INVENTION

This invention relates to an extended nip papermaker's press in which an induced electromagnetic repulsion force is applied to a belt, to urge or force the belt into pressing contact with a felt in the extraction nip. The force may be augmented as desired with a secondary force-inducing arrangement, such as with air pressure, to apply an augmented loading force to the nip.

In one form of the invention, the induced repulsion force is formed by an electromagnetic or a permanent magnet arrangement at the nip, in which a unitary pole as defined by either a north or south pole, is positioned in close but non-contacting relation to the surface of a pressing magnetized belt. The belt is formed as a permanent magnet, or is inductively magnetized, in opposed relation to the operative pole of the fixed magnet at the pressing nip, so that a repulsion force is formed therebetween tending to separate the belt from the fixed magnet. This force urges the belt into engagement with the felt, to apply a dewatering pressure to the paper web.

The belt may be formed of or include ferromagnetic material in the form of permanent magnets, and the latter may be of the type encapsulated into the belt material, or high energy rare earth or ceramic type material may be used to provide a thickness orientation to the poles, so that one surface of the belt assumes one polarity and the other surface of the belt assumes the opposite polarity. The belt may also be formed of material into which a strong magnetic polarization may be induced before the belt enters the nip. The magnetic polarization of the belt with respect to the fixed magnet places like poles in juxtaposition, thereby forming the repulsion force on the belt.

In another form of the invention, one or more current conductors in the form of current carrying coils are positioned in close proximity to a current conducting belt, preferably non-ferrous in nature, so that the flux field of the conductor intercepts the material of the belt and induces currents in the material of the belt. The orientation of the conductors to the belt is such as to generate an opposing electro-motive force (emf) in the belt at the nip, and this induced force in a direction as to urge the belt against the felt. The flux may be concentrated at the nip by the use of ferromagnetic poles, to improve efficiency.

With either form of the invention, the pressing force at the nip may be augmented by an air pressure housing. The housing is positioned over the electromagnetic or conductor elements, and forms a close fit with the belt. Air pressure exerts a force against the belt in the same direction as that of the induced or repulsion force, and, at the same time, provides cooling for the electric coil or coils.

It is therefore an object of the invention to provide an extended nip press for papermaking machinery in which a non-contacting repulsion force is applied at the nip through a belt.

Another object of the invention is the provision of a press, as outlined above, in which an electromagnet or a fixed permanent magnet is arranged to apply a repulsion force through a magnetized or magnet-carrying belt, to exert pressure on a felt and web.

A further object of this invention is the provision of a press, as outlined above, in which an electro-motive force is applied to a current conducting belt by one or more fixed electric current carry conductors, such as in the form of coils, to form a flux field, which may be augmented or concentrated by ferric poles. The force induced in the belt urges the belt and web against the backing roll, for the extraction of water therefrom.

These and other objects and advantages of the invention will be apparently from the following description, the accompanying drawings, and the appended claims.

BRIEF DESCRIPTION OF ACCOMPANYING DRAWINGS

DESCRIPTION OF THE PREFERRED EMBODIMENTS

Figure 1:
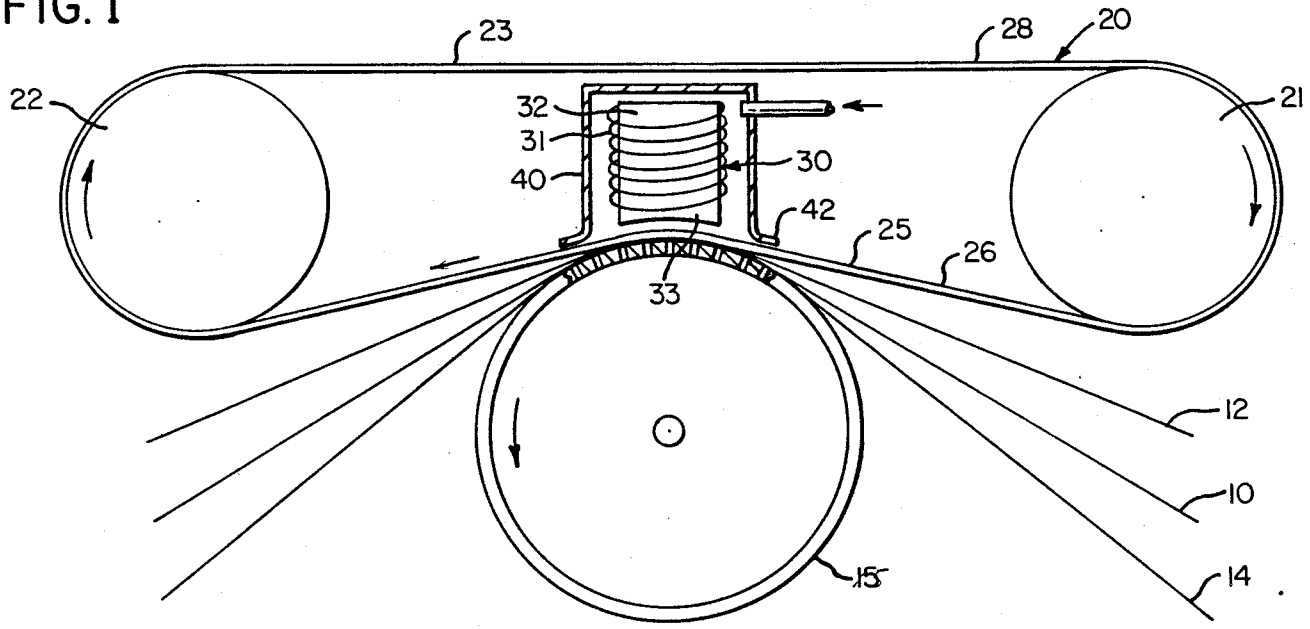
FIG. 1 is a diagrammatic end view of an extended nip press for a Papermaking machine in accordance with one embodiment of this invention.

Referring to the drawings, which illustrate preferred embodiments of the invention, an extended nip water-removing press for a papermaking machine is illustrated in FIG. 1. As shown, a web 10 of paper enters the nip supported on a papermaking felt. The embodiment as shown includes a top felt 12 and a bottom felt 14, with the paper web 10 therebetween, although it will be understood that a single felt may be used where the dewatering press is inverted, as shown in the previously identified U.S. Pat. No. 4,704,191.

The felts 12 and 14 carry or guide the paper web 10 in partially wrapped relation about a hollow extraction shell or roll 15. It will be understood that the shell 15 is designed for removing water from the nip and may be a suction roll which is slotted and/or grooved, or it may have blind drilled holes in its outer surface for water removal. A typical suction roll for this purpose is shown in the U.S. Pat. No. 4,366,025 of Gordan et al, issued Dec. 28, 1982, which has both blind drilled holes and through openings.

Means for applying pressure to the sandwich of felts 12 and 14, and the paper web 10, against the outer surface of the shell 15, includes an endless belt 20. The endless belt 20 is guided over a pair of rolls 21 and 22, one on either side of the niP. The top run 23 extends directly between the rolls 21 and 22. The bottom run 25 of the belt 20 is deflected into the space between the rolls 21 and 22 so as to partially wrap the shell 15 at the common nip with the web and felts. The bottom run 25 moves in the same direction as that of the felts and at the same speed.

The web, the felts, the rolls and the shell will have a width at least as wide as the web in the cross machine direction, which may be anywhere from less than 100" up to more than 300".

The belt 20 is formed with a finite thickness as required to supPort the magnetic material, in which the magnetic particles are oriented between the surfaces so as to define a permanent type thickness-oriented magnet. In other words, the belt 20 is permanently magnetized so as to form one pole, either a north (N) or a south (S) on its inside surface 26 and to form the opposite pole on its outside surface 28, throughout its width and length. Accordingly, the belt may be formed of a filled elastomer material, with oriented magnet ferrite particles which are capable of maintaining a relatively high magnetic energy, such as disclosed in the U.S. Pat. No. 4,126,567 of Otera et al. The belt 20 may be formed of material which may be inductively magnetized before entering the nip, or the magnetization may be augmented or reinforced by an electromagnet at a location outside the nip, to present an opposing pole surface to a fixed magnet in the nip.

Means interacting with the belt 20 and positioned in close flux-inducing, non-contacting relation to the belt at the nip includes a fixed magnet, illustrated generally at 30. As illustrated, the magnet 30 has a coil 31 wound about a core 32 so as to form a discrete pole at each end of the core. The end 33 of the core is arcuately curved so as to conform to the curvature of the belt 20 in the nip, and positioned in close, but non-contacting relation to the inside surface 26 of the belt run 25 at the common nip. The electromagnet 30 is polarized so as to present, at the surface 26 of the belt run 25, a like pole to the polarization of the belt. Thus, if the inside surface of the magnetic belt is a conventional north pole, the magnet 35 is polarized to present a north pole at the arcuately curved core face 33. While the magnet 30 is illustrated as an electromagnet at a single location in FIG. 1, it should be understood that one or more permanent magnets may be used, or that a plurality of electromagnetic coils could be distributed across the width of the machine, corresponding to the width of the belt 20.

When the magnet 30 is energized, a repulsion force is formed between the pole face 33 and the belt surface 25, which force urges the belt, in the nip, into pressing engagement with the felt-web sandwich and with the adjacent extraction surface of the shell 15. Since the pole face 33 is in non-contacting relation with the belt, no mechanical friction is produced, and accordingly, no lubrication is required as in cases where the pressing member comes into physical contact with the belt.

The pressing force on the belt may be augmented by enclosing the fixed magnets in an air pressure housing 40. The air pressure housing is closed on three sides as shown, with lower transversely oriented edges 42 in close but non-contacting proximity to the belt surface 26. Air under pressure, such as from 50 psi or less up to 300 psi or more, is applied to the interior of the air housing, which housing is suitably sealed at the ends as well as the side edges 42, to apply a downward pressure against the belt, accompanied by a controlled escape of air at the belt surface. Thus, the air pressure housing not only augments the thrust applied by the repulsion force between the magnets and the belt, but also serves to cool the electromagnets 30 and to cool the underlying surface of the belt 25.

Figure 2:
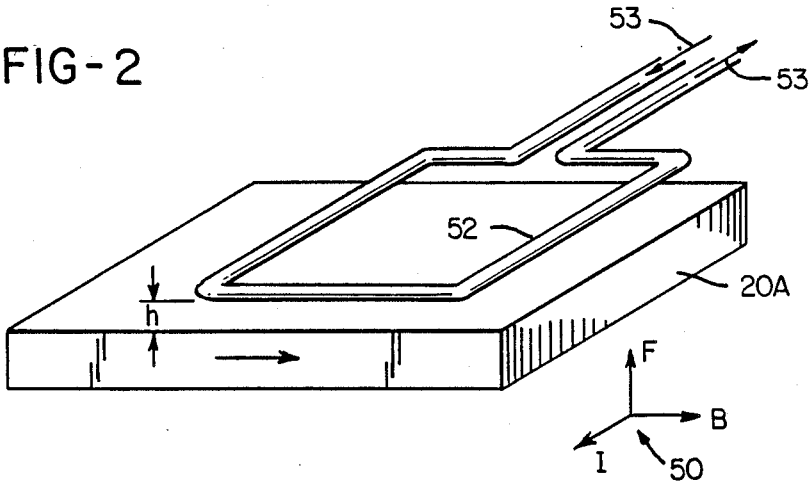
FIG. 2 is a diagram showing the inter-relation of a the conductors of a current carrying coil to a current conducting belt in accordance with a second embodiment of the invention.
Figure 3:
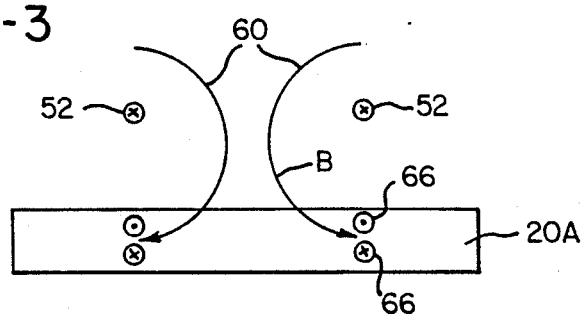
FIG. 3 is a diagram showing the relationship of the flux and induced currents of FIG. 2.
Figure 4:
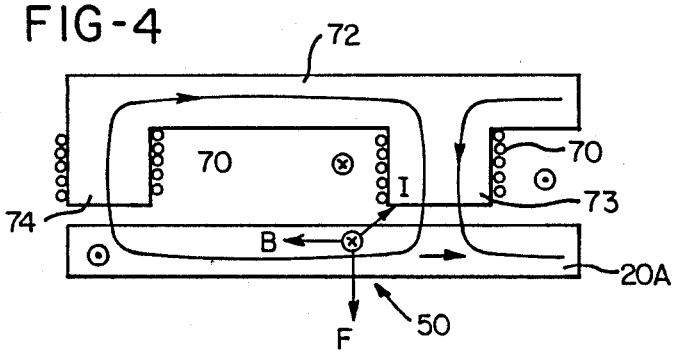
FIG. 4 is a diagram showing electric coils mounted on pole pieces for inducing flux and currents, for use in the embodiment of FIG. 2.

FIGS. 2–4 illustrate another embodiment of this invention in which an electromagnetic repulsion force in the belt, at the nip, is created by inducing electric currents within a current-carrying belt and thereby creating a counter electro-motive force (emf) within the belt. For this purpose, a non-magnetic, non-ferrous current-carrying belt **20*a*** is used. Copper, aluminum, and conductive elastomers are examples.

One or more current carrying coils, which may advantageously have flux-concentrating cores, may be used in this embodiment, and the principle of operation is diagrammed in FIGS. 2–4. In other respects, it will be understood that the air pressure shell or housing 40 as previously described, may be used with this embodiment.

Ampere's law asserts that any conductor carrying a current and located in a magnetic field at right angles to the flux will be pushed by a force which is proportional the flux density, the current and the length of the wire. Typical equations are derived for a particular shape of coil, usually circular, with consideration of the field intensity at any particular point, usually at the center of the coil. Typically, for a circular coil, the following force (F) formula applies:

$$F = \left(\frac{m}{r^2}\right)\left(\frac{I}{10}\right) 2\,PirN$$

The first term in the parenthesis, (m/r2) represents the flux density for the radial magnetic field at a distance "r" cm from a magnetic pole of strength "m", so that m divided by r2=the flux density B. The term in the second parenthesis, (2PirN) represents the total length of the wire in the coil, in centimeters, and may be represented by the term "L". Therefore, simplifying, the force F on any wire or current conductor in dynes may be written as follows:

$$F=(BIL)/10$$

Also, in accordance with Ampere's law, for any straight conductor of length L, the vector directions of the force F, the flux B, and current I, are mutually perpendicular as shown by the vector diagrams 50 in FIGS. 2 and 4. Thus, in FIG. 2, a coil of single turn is illustrated at 52 with a current flowing therethrough as indicated by the arrows 53.

It will further be understood that for any force applied to the coil, as described above, there will be an equal and opposite force applied to the belt **20*a*, as illustrated by the belt segment shown in FIG. 2. In the diagrams of FIGS. 2–4, the convention is employed in which a dot within a circle illustrates that the current is flowing toward the reader from the paper, and the X within a circle indicates that the current is flowing into the paper away from the reader. Thus, as illustrated in FIG. 3, the current flow in the coil wire 52a creates a flux fie)d as shown by the arrows 60, and the conductive belt 20a intercepts the flux 60 and circular currents are formed within the belt as indicated at 66**.

The induced force (emf) between the coil 52 and the current conductive belt 20a may, of course, be enhanced by concentrating the flux using pole pieces, as shown in FIG. 4. FIG. 4 diagrams a coil 70 wound about a magnetic yoke 72, with the flux being concentrated through a pole 73. The force-flux-current vector diagram 50 is again repeated to show the reaction force on the belt 20a. It will be noted that the force concentration will be somewhat offset from the center of the pole, as shown, and it is obvious that this will be balanced by an equal and opposite force at the adjacent pole 74, which should be laterally spaced from the pole 73.

In the suggested diagram of FIG. 4, the pole 73 will be positioned at the nip, in the position of the pole 33 of FIG. 1, where the pressure by repulsive force is to be applied to the web. The laterally offset pole 74 will be located beyond the nip so that the attraction force between the belt and the pole will not adversely affect the repulsive pressing force, since the belt 20a is assumed to be flexible.

Accordingly, a coil 52 and pole or multiple pole arrangement as shown in FIG. 4 in association with the coil 70 and yoke 72 may be substituted for the electromagnet 30, in the embodiment of FIG. 1, and in combination with the current carrying belt 20, to provide a repulsion force to the belt within the nip. Likewise, as previously described, the air pressure housing 40 may be used to augment the force and to provide cooling for the associated coils.

In either embodiment, the belt 20 or 20a may be impervious, may be formed with an openness, such as a mesh. The latter may be of particular advantage when employed in the embodiment of FIGS. 2 through 4 since the mesh would conveniently provide current conducting paths for the flow of current induced by the coils 52 or 70.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An extended nip press for a papermaking machine through which a web of paper passes between a forming felt and a backing roll for the extraction of water therefrom, the improvement comprising:

a belt formed of a electric current conducting nonferrous material, means positioning said belt for applying pressure to said felt against said backing roll, a relatively fixed magnetic flux induction coil positioned in close flux-inducing and non-contacting relation to said belt on a side thereof opposite from said felt, and means applying a direct current to said coil to induce a repulsion force in said belt by inducing a current flow in said belt for urging said belt against said felt.

2. The press of claim 1 in which said coil includes a flux-carrying yoke positioned to concentrate the flux of said coil in said conductive belt.

3. The press of claim 1 further comprising an air pressure housing over said coil, said housing having edges in close and non-contacting proximity to said side of said belt opposite said felt and means for applying air under pressure to said housing for applying a pressure against said belt to augment the force induced by said coil.

* * * * *